US007114873B2

(12) United States Patent
Rastegar et al.

(10) Patent No.: US 7,114,873 B2
(45) Date of Patent: Oct. 3, 2006

(54) ADAPTIVE SECURITY AND PROTECTIVE BARRIERS AND TRAFFIC CONTROL SPEED BUMPS

(75) Inventors: Jahangir S. Rastegar, Stony Brook, NY (US); Thomas Spinelli, East Northport, NY (US)

(73) Assignee: Omnitek Partners LLC, Bayshore, NY (US)

( * ) Notice: Subject to any disclaimer, the term of this patent is extended or adjusted under 35 U.S.C. 154(b) by 0 days.

(21) Appl. No.: 10/796,933

(22) Filed: Mar. 10, 2004

(65) Prior Publication Data

US 2005/0201827 A1 Sep. 15, 2005

Related U.S. Application Data

(60) Provisional application No. 60/488,126, filed on Jul. 17, 2003.

(51) Int. Cl.
*E01F 13/00* (2006.01)

(52) U.S. Cl. ..... 404/6

(58) Field of Classification Search ..... 404/6, 404/9, 15; 49/131
See application file for complete search history.

(56) References Cited

U.S. PATENT DOCUMENTS 1,203,006 A * 10/1916 Keenan ..... 49/82.1
1,603,846 A * 10/1926 Garcia ..... 49/33
1,616,819 A * 2/1927 Norris, Jr. ..... 137/543
1,878,234 A * 9/1932 Goodman ..... 49/134
2,075,892 A * 4/1937 Evans ..... 49/134
2,403,014 A * 7/1946 Nampa ..... 49/13
2,627,920 A * 2/1953 Barlow ..... 188/32
2,917,283 A * 12/1959 Sumners ..... 256/1
4,332,503 A * 6/1982 Hurst, Jr. ..... 404/11
4,342,525 A * 8/1982 Mastronuzzi, Jr. ..... 404/6
4,354,771 A * 10/1982 Dickinson ..... 404/6
4,861,185 A * 8/1989 Eikelenboon ..... 404/6
4,893,119 A * 1/1990 Nasatka ..... 340/928
5,419,537 A * 5/1995 Thompson ..... 256/17
5,486,065 A * 1/1996 James ..... 404/15
5,639,178 A * 6/1997 Wilson et al. ..... 404/6
6,010,277 A * 1/2000 Follman ..... 404/11
6,409,418 B1 * 6/2002 Blair et al. ..... 404/6
6,702,512 B1 * 3/2004 Reale ..... 404/6

* cited by examiner

*Primary Examiner*—Gary S. Hartmann

(57) ABSTRACT

A method for at least slowing a vehicle moving along a surface is provided. The method including; providing one or more panels capable of extending above the surface; and deploying the one or more panels from the surface into a position extended from the surface.

8 Claims, 6 Drawing Sheets

ADAPTIVE SECURITY AND PROTECTIVE BARRIERS AND TRAFFIC CONTROL SPEED BUMPS

CROSS-REFERENCE TO RELATED APPLICATIONS

This application claims the benefit of U.S. Provisional Application Ser. No. 60/488,126 filed Jul. 17, 2003, the entire contents of which is incorporated herein by its reference. This application is also related to co-pending U.S. patent application Ser. No. 10/372,496 entitled "Roadway For Decelerating and Accelerating a Vehicle Including an Aircraft," filed on Feb. 24, 2003, the contents of which are incorporated herein in its entirety by this reference.

BACKGROUND OF THE INVENTION

1. Field of the Invention

The present invention relates generally to vehicle barriers and speed bumps, and more particularly, to an adaptive security and protective barrier and traffic control speed bumps.

2. Prior Art

Concrete blocks of various designs have long been used as security barriers to barricade sensitive areas and buildings or to provide the means to slow down and control traffic for inspection and/or identification checking or other similar security reasons. Such barriers are also used on a segment of a road to form a maze to force vehicles to slow down; to provide the means to prevent vehicles from passing a checkpoint at high speed; and to make it easier for the security personnel to intercept those who refuse to stop for inspection.

The concrete and water filled plastic barriers rely on their weight to generate enough friction force to slow down and eventually stop even a heavily loaded truck. The barriers are also large enough so that in case that the wheels go over them, the bottom surfaces (chassis or other components) of the vehicle would land over the barriers, making it impossible for the vehicle to proceed any further.

Concrete barriers used for traffic control at checkpoints, however, can only be used to slow down the traffic by forming a maze but not to completely close the roadway. This is obviously the case since the concrete barriers are very heavy and can only be moved by cranes. As a result, such security barriers must still allow passage of vehicles, but at lower speeds, and the security personnel must rely on their own speed and firepower to disable the vehicle or its driver, or to drive one of their own vehicles to a position to block the barrier's outlet. Thus, concrete barriers do not provide effective means to control the traffic at checkpoints. Such security barriers are also not safe for the security personnel, relies on their very rapid reaction and proper use of firepower to disable the car or its driver or block its passage by another vehicle. Other shortcomings of such checkpoints include the requirement of a considerable number of security personnel to operate the checkpoint; that the security personnel have to get close to the vehicle for its inspection without the opportunity of utilizing (at least initially) a remotely operated visual inspection tool; and the barriers cannot be used to trap a suspect vehicle for further action. Concrete barriers are also very unsightly and require a considerable amount of time to remove from the site and transport to a storage site.

As barriers to barricade sensitive areas and buildings, concrete blocks are very unsightly; require a considerable amount of time to be transported from storage sites, and require cranes to place them at the desired locations and to remove them once the threat level has been reduced. In addition, access to the building or the area to be protected cannot be completely blocked by concrete barriers since materials and equipment may have to be at times delivered to the barricaded buildings or other vehicles may have to have access to the barricaded buildings.

Speed bumps are also known in the art. Generally, speed bumps are formed with the roadway or placed on top of the roadway to regulate the speed of vehicles crossing over them. The speedbumps are generally low enough for vehicles to safely cross yet high enough to force a vehicle to slow down while crossing. However, different types of vehicles have different thresholds for crossing speedbumps. For example a sports car that is low to the ground can tolerate a much lower speedbump than a utility vehicle or truck can. Also, the height of a speedbump may be sufficient for an intended purpose, such as regulating a speed in front of a school during school hours. However, when such intended purpose changes, such as in front of the school when school is not in session (e.g., at night and on the weekends), the speedbumps continue to regulate the speed for the originally intended purpose.

SUMMARY OF THE INVENTION

A need therefore exists for novel security and protective barrier technologies that address the aforementioned shortcomings of the currently available roadway barriers, such as those barriers employing a concrete block design. The barriers disclosed herein have many applications, such as highly effective security barriers for checkpoints that could be operated safely by significantly fewer personnel and that could also be used as barriers for barricading buildings and other sensitive areas. The barriers disclosed herein also utilize existing and mass-produced off-the shelf components. They can be constructed as passive barriers or readily be equipped with simple and readily available sensory inputs to convert them to sophisticated security and protective barriers. The barriers disclosed herein may also be retracted to be hidden from sight in a fraction of a second and may also be deployed in a fraction of a second from a remote location. The barriers disclosed herein can have a higher initial cost to install. However, the reduction in the cost of operating security checkpoints and barricades in terms of the significant reduction in the number of security personnel and the cost of transporting the barriers back and forth to the storage can quickly recover the extra cost as compared to barriers of the prior art, such as concrete barriers. In addition, the barriers disclosed herein have a significant commercial market not only in the areas of security and protective barriers, but also in the area of speed control, such as for "smart speed bumps" that allow a smooth drive for vehicles that are driving at speeds below the area limits and can deploy to regulate the speed of vehicles traveling above the area limits.

Thus, the barriers disclosed herein can be part of a novel family of technologies with immediate homeland security applications in at least the following areas:

1. Deployable vehicular security barriers.
2. Deployable high-speed car (truck) bomb stopping and entrapping protective barriers.
3. Traffic speed control barriers.

Accordingly, a system for at least slowing a moving vehicle traveling along a surface is provided. The system comprising: one or more panels movably disposed on the surface between a first position substantially flush with the surface and a second position deployed from the surface; and one or more spring units for biasing each of the one or more panels into the second position.

The system can further comprise one or more damper units for damping a movement of the one or more panels between the first and second positions. In which case, the system can further comprise: a sensor for detecting at least one of a speed and weight of the moving vehicle; and a controller operatively connected to both the sensor and the one or more spring and damper units for controlling the one or more spring and damper units to move the one or more panels between the first and second positions based on the detected weight and/or speed of the moving vehicle.

The system can further comprise: a sensor for detecting at least one of a speed and weight of the moving vehicle; and a controller operatively connected to both the sensor and the one or more spring units for controlling the one or more spring units to move the one or more panels between the first and second positions based on the detected weight and/or speed of the moving vehicle.

The one or more panels can comprise two or more panels, each of which is rotatable in a same direction.

The one or more panels can comprise two panels, each of which is rotatable in a different and opposite direction. In which case, the system can further comprise one or more center panels disposed between the two panels, the center panel having a top surface substantially parallel with the surface, the center panel having one or more spring units for moving the top surface between the first position and an extended position in which the top surface is extended above the surface. In the second position an end of each of the panels can be substantially at the extended position.

The surface can be a roadway.

Also provided is a roadway block comprising: at least first, second, and third surfaces, wherein at least two of the first, second, and third surfaces can be in communication with a roadway surface such that another of the first, second, and third surfaces is used as a barrier to at least slow a vehicle.

The at least first, second, and third surfaces can comprise first, second, third and fourth surfaces.

One of the first, second, and third surfaces that can be in communication with the roadway surface can have a longer length than the other of the first, second, and third surfaces that can be in communication with the roadway surface.

Still further provided is a roadway barrier for at least slowing a moving vehicle along a surface. The roadway barrier comprising: at least one first block having an inclined surface with respect to the roadway and at least a second surface substantially perpendicular with respect to the surface; wherein in a first configuration, the first block is positioned such that the second surface is in contact with the surface and the inclined surface is positioned for movement of the vehicle over the inclined surface; and wherein in a second configuration, the first block is positioned such that the second surface is positioned to be substantially perpendicular to the surface and to a direction of travel of the vehicle.

The at least one first block can comprise two first blocks each of which is placed in the first configuration with the inclined surface of one of the first blocks opposing the inclined surface of the other of the first blocks so as to form a speedbump. In which case, the roadway barrier can further comprise a center block disposed between the two first blocks, the center block having a top surface which is above the surface at substantially the same height as an extreme portion of the inclined surfaces for each of the two first blocks.

Still yet further provided is a method for at least slowing a vehicle moving along a surface. The method comprising; providing one or more panels capable of extending above the surface; and deploying the one or more panels from the surface into a position extended from the surface.

The method can further comprise lifting at least a portion of the vehicle above the surface with the one or more panels. The lifting can comprise lifting the entire vehicle above the surface.

The method can further comprise: detecting at least one of a vehicle speed, vehicle type, and vehicle weight; and controlling the one or more panels based on the detecting.

The one or more panels can comprise two or more panels rotatably disposed on the surface, wherein each of the one or more panels rotate in a same direction.

The one or more panels can comprise two or more panels rotatably disposed on the surface, wherein each of the two or more panels rotate in a same direction.

The one or more panels can comprise first and second panels rotatably disposed on the surface, wherein each of the first and second panels rotate in a different and opposite direction. In which case, the method can further comprise providing at least one center panel disposed between the first and second panels, the second panel being capable of being deployed into a position extended from the surface. The method can further comprise: detecting at least one of a vehicle speed, vehicle type, and vehicle weight; and controlling the first, second, and center panels based on the detecting. The controlling can control the first, second, and center panels to act to regulate a speed of the vehicle. The controlling can also control the first, second, and center panels to act as a security barrier against the barrier.

Still further provided is a system for at least slowing a moving vehicle traveling along a surface. The system comprising: one or more panels movably disposed on the surface between a first position substantially flush with the surface and a second position deployed from the surface; means for moving each of the one or more panels into the second position.

Still yet further provided is a modular set of blocks for restricting a movement of a vehicle along a surface, the modular set of blocks comprising: one or more inclined blocks, each having two perpendicular sides connected by an inclined side.

The modular set of blocks can further comprise one or more additional blocks, wherein the one or more additional blocks having three or more sides, at least one of the sides having a dimension substantially equal to a dimension of at least one of the two perpendicular sides and inclined side.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of surfaces, it has been found particularly useful in the environment of roadways. Therefore, without limiting the applicability of the invention to use on roadways, the invention will be described in such environment. However, those skilled in the art will appreciate that the speedbumps and barriers of the present invention also have utility for use on other surfaces, including natural surfaces, such as grass and dirt.

Figure 1:
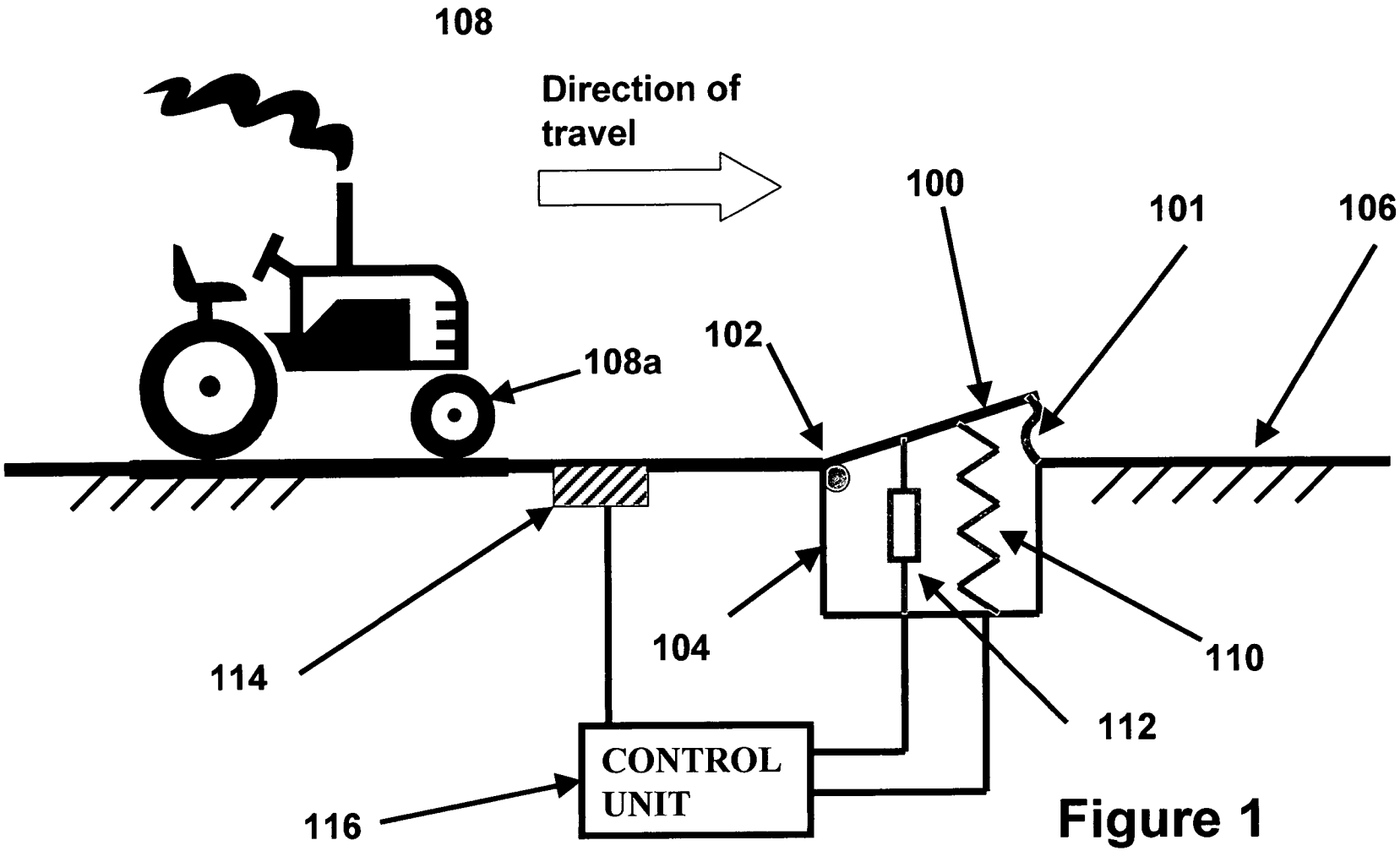
FIG. 1 illustrates an embodiment of a speedbump system of the present invention.

A basic operation of an embodiment of a barrier of the present invention is shown in the schematic of FIG. 1. In FIG. 1, the operation of the security barrier acting as a traffic speed control device (alternatively referred to herein as a "speedbump") is shown. Two of the major variations to this device for providing "deployable vehicular security barriers" and "deployable high-speed car (truck) bomb stopping barriers" are described below.

The speedbump includes at least one panel 100, which is hinged about a hinge or pivot 102 to a structure 104 that is embedded in the roadway 106. The panel 100 is preferably fabricated from a strong and rigid, but lightweight material such as metal-matrix-composites, otherwise with steel and coated or painted to prevent corrosion. The hinge 102 can be any rotating joint known in the art and is preferably low-profile such that it remains flush with the roadway 106 when the panel 100 is closed. The structure 104 is preferably a housing embedded in the roadway 106 and can be steel or any other strong material that can withstand being buried and can support the panel 100 and the forces of a vehicle passing over it. Although the panel 100, hinge 102 and structure 106 are shown in cross-section, they are assumed to have a width at least as long as the width of a vehicle 108 traveling along the roadway 106. The panel(s) may be a single unit along such width or one or more panels may be situated side-by-side along the width. Also, although, the width of the panel(s) should be at least as wide as the vehicle, they can also cover the entire or substantially entire width of the roadway. Furthermore, although one such panel 100 and associated elements is shown in FIG. 1, those skilled in the art will appreciate that two or more such panels 100 and associated elements can be disposed in the roadway in the direction of the vehicle's 108 travel. Each panel, preferably consists of two or more segments that are hinged together, by a regular hinge, a living joint, or a flexural element, so that the motion of the tire over the panel becomes smooth. The panel 100 may be normally open (as shown in FIG. 1) or may be normally flush with the roadway 106 and opened on command. The panel 100 may be provided with a dirt guard, such as a flexible rubber bellows 101 to seal the housing from the outside environment to prevent foreign materials from entering into the housing.

The panel 100 is held at its open position by spring units 110. Viscous damper units 112 are used to provide speed dependent forces that would control the panels 100 reaction to the passing vehicle 108. Although a single spring and damper unit 110, 112 is shown, they can be disposed along the width of the panel 100 as necessary. Both the spring and damper 110, 112 units are fixed to both the structure 104 and panel 100, preferably by a rotating joint (not shown).

The spring and damper parameters of the spring and damper units 110, 112 can be selected to allow for smooth passing of vehicles of certain weights with speeds of up to a predetermined level. For speeds below the set limit, as the vehicle's tire 108*a* roles over the panel 100, the weight of the vehicle 108 begins to close the panel 100 by compressing the spring unit 110 and displacing the damper unit 112. If the spring and damper rates are selected properly, the total force generated by the spring and damper units 110, 112 in the vertical direction (vertically up from the roadway 106) is less than the weight of the vehicle 108 on the passing tire 108*a*. As a result, the panel 100 is closed by the tire 108*a* as it rolls over the panel 100, and no considerable vertical motion (bumping action) will be induced in the tire 108*a*. However, as the speed of the passing vehicle 108 is increased, the vertical force generated by the viscous damper unit 112 increases, and beyond certain speed (speedbump speed setting), the total vertical force exerted by the panel 100 on the tire 108*a* becomes greater than the weight of the vehicle 108 on the passing tire 108*a*, and the tire 108*a* and the vehicle 108 will experience a vertical motion (speedbump action) and a deceleration. Thus, the speedbump also serves to slow down the vehicle 108 if it is moving too fast over the panel(s) 100. A similar device for decelerating vehicles is described in co-pending U.S. patent application Ser. No. 10/372,496, the disclosure of which is incorporated herein in its entirety by its reference.

In an adaptive version of the speedbump of FIG. 1, a sensor 114 is provided in the roadway 106 before the panel(s) 100. That is, the sensor 114 is positioned in the roadway 106 such that a vehicle 108 approaching the panel(s) 100 will first pass over the sensor 114 before passing over the panel(s) 100. As the vehicle 108 approaches the panel(s) 100, the sensor 114 is crossed. The sensor 114 is of a type for determining the speed and/or the weight of the vehicle 108. Such roadway sensors 114 are well known in the art. The speed and/or weight are fed to a control unit 116 that is operatively connected to the spring and damper units 110, 112 and adjusts the damper and/or the spring rates of the spring and damper units 110, 112 to achieve the desired performance. The control unit 116 can be embedded in the roadway, disposed above the roadway, or integral with the structure 104. For example, if the sensor 114 detects a large weight vehicle 108, the spring and/or damper rates of the spring and damper units 110, 112 can be increased. Spring and damper units 110, 112 having adjustable spring and damper rates are well known in the art. For example, the damper filled with magnetorestrictive fluid may be used, which upon the application of a magnetic field through a coil, its viscosity, thereby the damping rate of the damper is varied. Also, an example of adjustable rate springs are air springs that work with compressed air, in which their spring rates are varied by varying the air pressure within the air spring. Thus, the speedbump can adapt according to a speed and/or weight of a vehicle entering the panel(s) 100. If multiple panels 100 are used, they can all be adaptive in that the spring and/or damper rates of their respective spring and damper units 110, 112 can be controlled. However, such multiple panels can be controlled together (e.g., all the spring and damper units 110, 112 of each panel are controlled the same) or they can be controlled independently (e.g., the spring and damper units of each of the panels 100 are controlled independently). Another mode of adapting the spring and/or damping rates to the speed and weight of the vehicle is by controlling the rate and amount of panel rotation as the tire moves over it by a feedback signal.

The traffic speed control units discussed with regard to FIG. 1 are designed for the control of the speed of incoming traffic. The units are designed to work as smart versions of currently used fixed speed bumps. When the speed of an incoming vehicle is below a certain set limit (threshold), the unit allows for a smooth ride across (over) the unit, i.e., it does not act as a speed bump. Otherwise, the unit acts as a speed bump, with increased severity at higher speeds and/or weights.

The spring and viscous damper rates of the spring and damper units 110, 112 are generally set to allow complete closure of the panels 100 under the weight of the passing tire(s) 108*a* when the speed of the vehicle 108 is below the preset limit. Once the tire 108*a* has passed over a panel 100, the viscous damper 112 ensures that the panel 100 opens relatively slowly.

The traffic speed control units may be constructed with a wide range of intelligence and adaptive capabilities, including the following:

1. Completely passive units with preset but adjustable speed limit control;

2. Units with actively controlled speed limit (closed-loop) control. Speed limit may be set manually or remotely from a central control station or by a sensor network;

3. Manually deployable and retractable units;

4. Units that are deployed by a remote signal from a central control station or by a sensor network;

5. Units that are retracted by a signal received by an authorized vehicle such as police, ambulance or fire department vehicles.

Units may be equipped with manual and/or remote "bump" height adjustment capability. A height adjustment signal may be generated at a central control station or may be generated automatically by a sensor network controller.

The panel(s) 100 discussed above can also operate as a security barrier. In such a configuration, the panel(s) 100 are deployed on command by an actuation mechanism. The actuation mechanism is preferably an integral part of the spring or viscous damper units 110, 112. This is accomplished, for example, by using an air or hydraulic spring as the spring unit 110, or by combining a hydraulic or pneumatic cylinder (not shown) with the viscous damper unit 112. In addition, to provide a proper security barrier, the panels 100 can be held at steeper (more vertical) angles and are wide enough to cover the entire width of the road or pathway that is being secured. The barriers are intended to replace concrete mazes used to force incoming vehicles to slow down for inspection or identification check or to facilitate interception. The main advantages of the security barriers include:

a) The security barriers can cover the entire path of travel (e.g., the entire width of the road or pathway), thereby allowing total access control.

b) The security barriers can be deployed or retracted, allowing them to be placed almost totally out of view when in the retracted position (they could even be buried under a lawn, dirt or other natural surface).

c) The security barriers can allow for selective activation for various degrees of control, for example in response to level of terrorist threats or for merely redirecting traffic.

d) The security barriers can be permanently installed and have a better appearance than temporary concrete barriers.

e) The security barriers can be integrated into a building's overall security and access control, training and drills system.

f) The security barriers can be programmed to achieve specific goals such as "entrapment", "protecting building", and/or allow "evacuation".

g) The security barriers can be used to force a reduction in the speed of selected or all incoming vehicles.

h) Security barrier control signals may be generated at a central control station or automatically by sensor network control units.

i) If struck by a vehicle, the security barriers can be designed to absorb a considerable amount of the kinetic energy of the vehicle without any damage.

The aforementioned deployable vehicular security barriers can be designed to provide the means to not only stop high-speed car and truck bombs, but also to trap them in a secured area and in a position that if the explosives are detonated, the damage to the surrounding area is minimized. The latter goal is accomplished by ensuring that the vehicle is propped a certain distance above the ground, thereby preventing the full force of an explosion to be directed in one direction. In addition, it is possible to deploy additional barriers around the vehicle to trap the occupants and to minimize the force of explosion. The barriers can be readily designed to handle heavily loaded car or truck bombs moving at very high speeds.

Figure 2A:
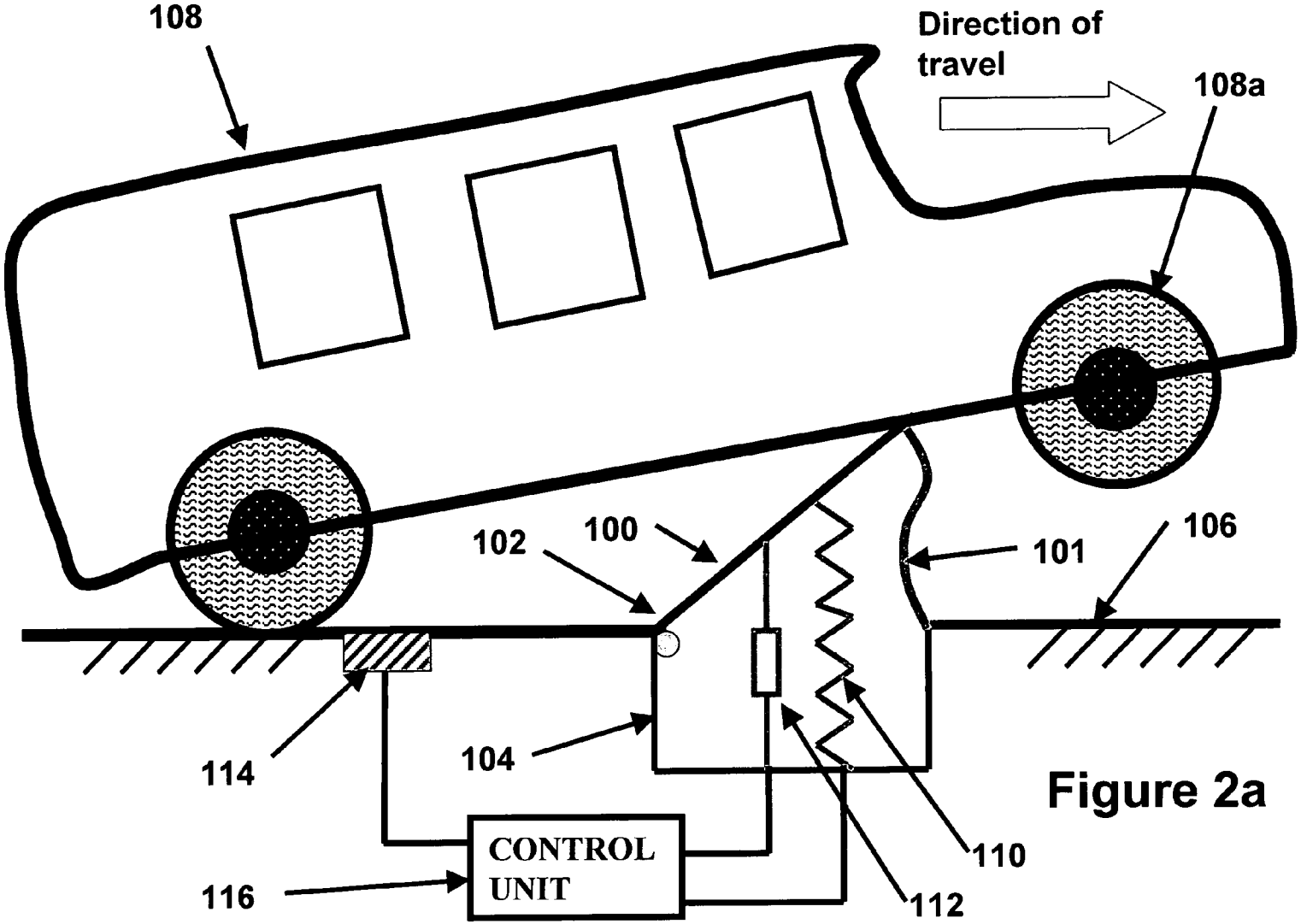
FIG. 2*a* illustrates an embodiment of a security barrier of the present invention in which a vehicle is partially lifted above the ground.
Figure 2B:
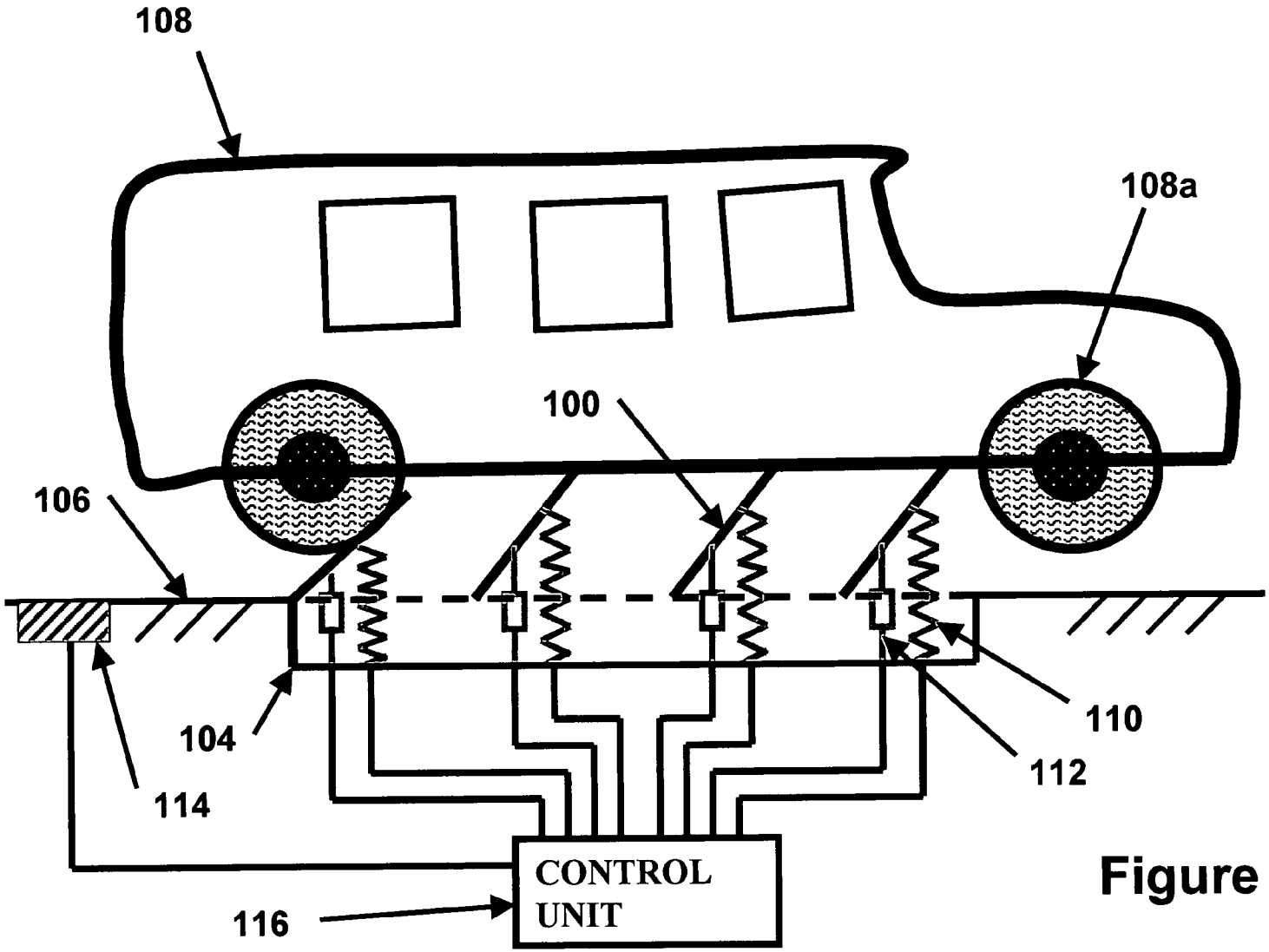
FIG. 2*b* illustrates an embodiment of a security barrier of the present invention in which a vehicle is totally lifted above the ground.

In this design, the barriers are used to absorb part of the kinetic energy of the vehicle with the viscous dampers (shock absorbers) 112; part of the kinetic energy through friction forces between the vehicle chassis and the panels 100; and by transferring part of the kinetic energy of the vehicle 108 to potential energy by raising the vehicle 108 over the security barrier panels 100. In addition, the barriers can be designed to raise the heaviest vehicle 108 high enough to keep its wheels 108*a* off the ground by supporting its weight on the chassis as shown in FIG. 2*a*. In this schematic, only one barrier panel 100 is shown for the sake of clarity. In practice, several barriers can be positioned in parallel along the path of vehicle travel, and a vehicle that refuses to stop will be brought to stop over two or more barrier panels 100 with all its wheels off the ground, as shown in FIG. 2*b*.

The proposed security and protective barriers will provide a very effective means to safely and with negligible damage to the barrier system to bring a vehicle 108 to a stop, regardless of its weight and speed. The system can readily be made adaptive to the speed and weight of the vehicle for optimal performance by installing simple weight and speed measuring sensors 114 along the path of travel of the vehicle 108. The measurements can then be used to adjust the various parameters of the security barriers, e.g., the spring and viscous damping rates of the spring and damper units 110, 112 and the height of the panel(s) 100. In addition, additional preloaded spring units 110 may be released to provide additional weight support. In such designs, a portion of the preloaded spring units 110 are initially disengaged from the panels 100 and are subsequently released to provide the required support for the weight of the vehicle 108. The preloaded spring release mechanism and the number of released preloaded spring units may, for example, be determined automatically by the weight of the vehicle as measured by the system sensor 114. Similarly, brake elements may also be added.

The above speed control bumps and traffic control barriers are preferably built into the roads and pathways where they are to be deployed. As such they are not portable. To be portable, they must also be relatively lightweight. Such portable units may be constructed and installed into one or more covered compartments and built in the desired locations when needed.

Figure 3A:
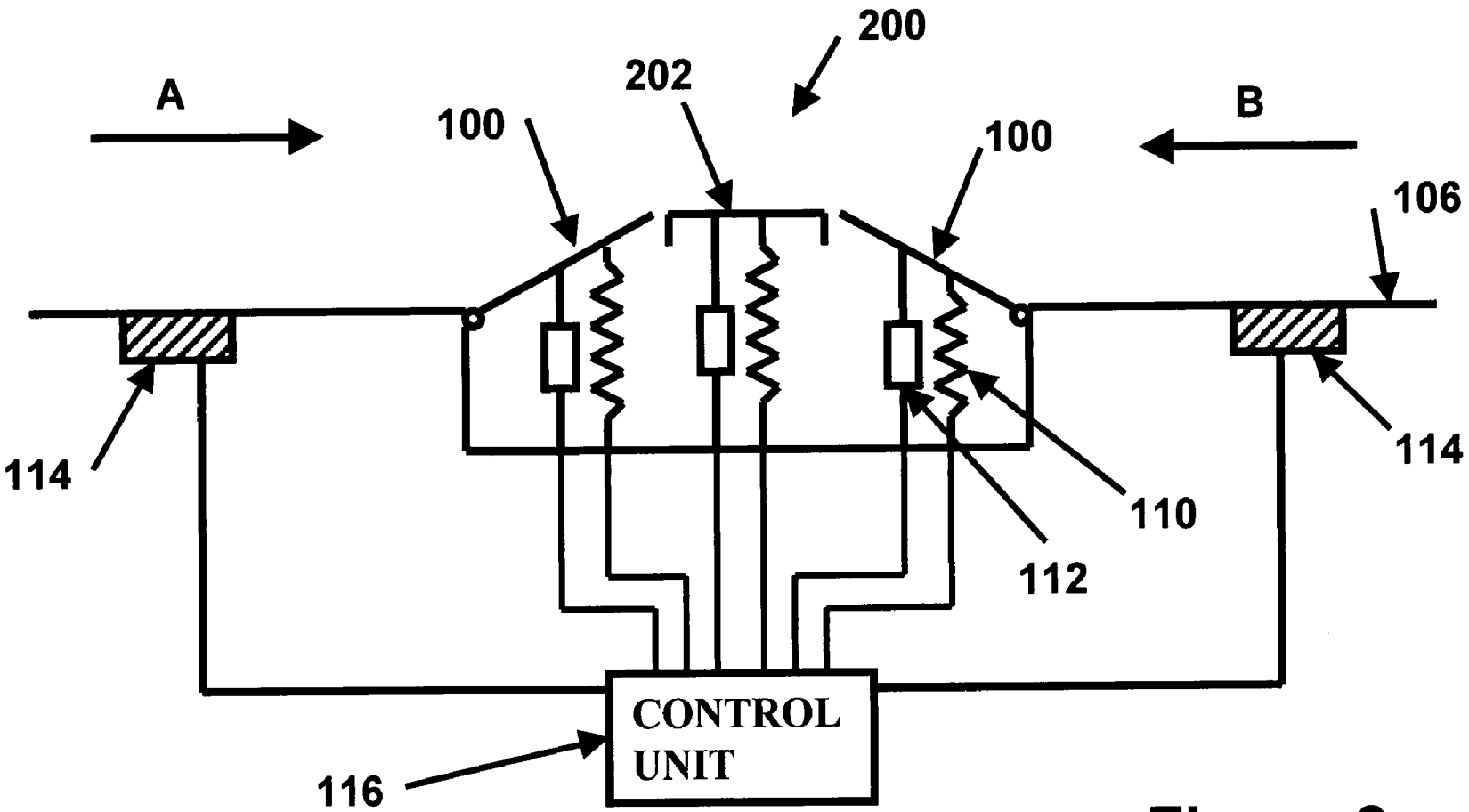
FIG. 3*a* illustrates an embodiment of an adjustable, multi-direction, and multi-purpose speedbump and security barrier.

Referring now to FIG. 3*a*, there is shown a multi-directional and multi-purpose speedbump and security barrier, generally referred to by reference numeral 200 in which like reference numerals refer to like features. In the system 200 of FIG. 3*a*, there is provided two panels 100, each being hinged 102 to a structure 104 embedded in the roadway and each having associated spring and damper units 110, 112. In the system 200 of FIG. 3*a*, the panels 100 face each other so as to be capable of slowing and/or stopping vehicles from either direction (A and B). The spring and damper units 110, 112 for each panel 100 is also operatively connected to a roadway sensor 114 and control unit 116 as discussed above. Thus, the opposing panels 100 may be controlled as discussed above to act as either a speedbump, security barrier, or may be utilized to lift a vehicle at least partially off the ground. As a speedbump, both panels 100 may be used together to provide a smoother transition from and back to the roadway for the tires crossing over the panels. Furthermore, the right panel 100 can be used as a security barrier for vehicles traveling in the A direction and the left panel 100 can be used as a security barrier for vehicles traveling in the B direction. If the right sensor 114 detects a vehicle coming from the B direction, the left panel 100 may be deployed to act as a security barrier against the vehicle. Similarly, if the left sensor 114 detects a vehicle traveling in the A direction towards the system, the right panel 100 may be deployed to act as a security barrier against the vehicle. The panels 100 can be deployed solely by a signal from the sensors 114, or the sensor may indicate a warning to personnel, who then would make the decision to deploy the panel(s) 100. Other artificial logic can also be employed in the decision to deploy the panels 100, such as computer vision to detect the type of vehicle.

Additionally, one or more center panels 202 can be provided between the panels 100. The center panel(s) 202 are also controlled with spring and damper units 110, 112 preferably under the control of the control unit 116 and sensors 114. The center panel 202 preferably has a substantially flat upper surface 204 that translates parallel to the roadway 106. The center panel 200 can be used in combination with the other two panels 100 when the system acts as a speedbump to provide smoother transition to and from the roadway 106. The center panel 200 can also be used by itself or in combination with one of the panels 100 when the system acts as a security barrier. The center panel 200 can float above the roadway under the support of the spring and damper units 110, 112, or one or more linkages or mechanisms can be employed for maintaining a parallel relationship with the top surface 204 and the roadway 106. Such mechanisms are well known in the art. Rubber or other flexible materials (not shown) can be disposed between the panels 100 or between the panels and the center panel 200 to prevent debris and water from entering the system.

Figures 3B, 4A, 4B:
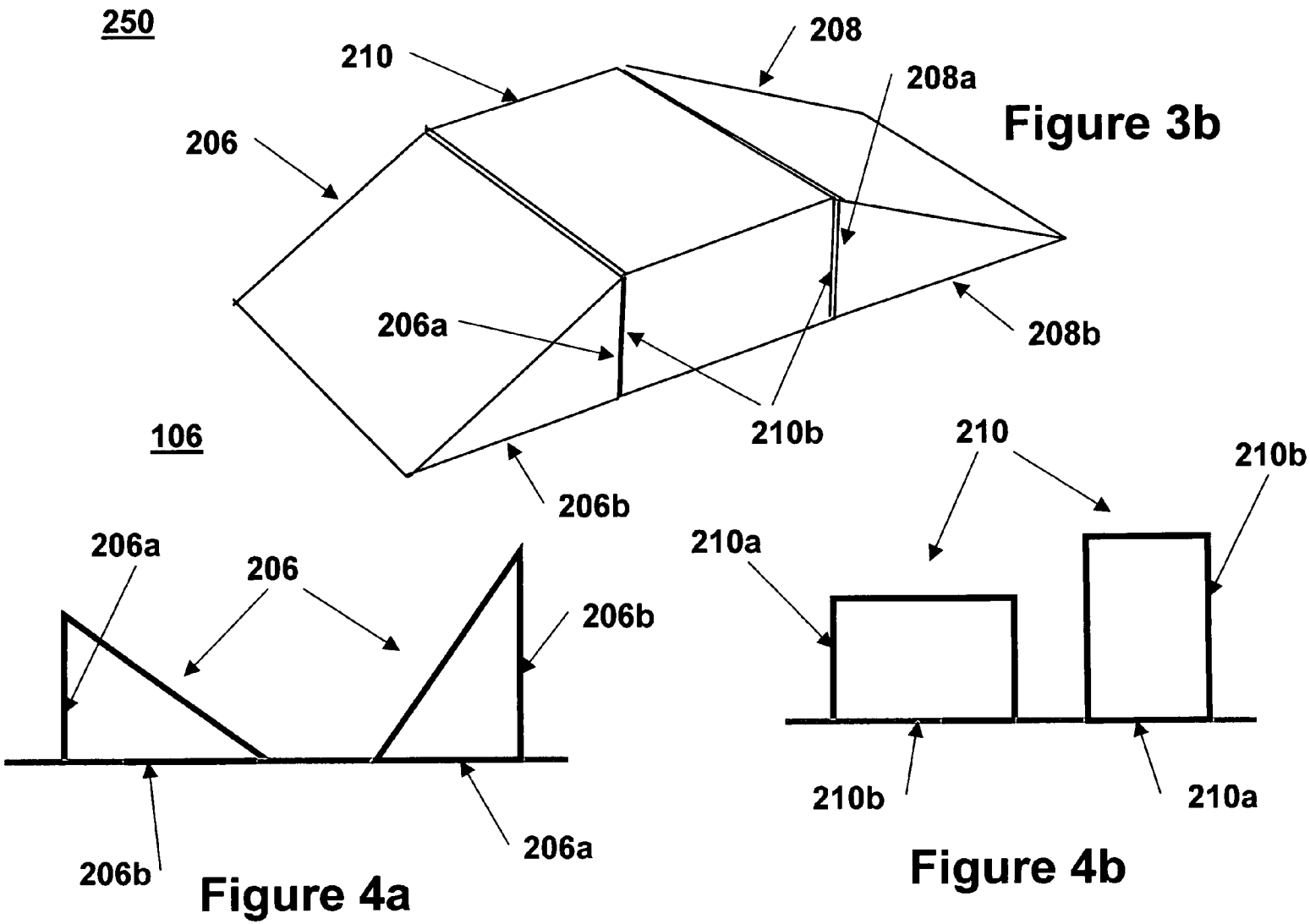
FIG. 3*b* illustrates an embodiment of a modular multi-direction, and multi-purpose speedbump and security barrier blocks.
FIGS. 4*a* and 4*b* illustrate different configurations for the blocks of FIG. 3*b*

Referring now to FIG. 3*b*, the system of FIG. 3*a* can also be configured as three modular units, one up ramp 206, one down ramp 208 and one middle unit 210. The ramps 206, 208 and the middle unit 210 can be constructed with plates and other structural materials to be relatively lightweight and can be attached in the field to form an entire unit. Obviously a unit may be assembled with more than one middle unit 210 or with one or no ramp units. The height of the ramp units 206, 208 and the middle unit 210 can be fixed or may be provided with a height adjustment mechanism. The unit 250 may be rigid to act as a regular speed control bump or act together as an adaptive speed control unit. Preferably, the blocks 206, 208, 210 has or more sides having a dimension substantially equal to a dimension of at least one of the sides of one or both of the other blocks so that they can be used together as a unit.

The back 206*a*, 208*a* of the ramps 206, 208 or the side plates 206*b*, 208*b* of the ramps 206, 208 or the middle units 210 may be placed on either of their sides as shown in FIGS. 4*a* and 4*b*, respectively, to transform them into traffic control units similar to those described above. The sides 206*a*, 206*b*, 208*a*, 208*b*, 2010*a*, 210*b* can be the same length or one can have a larger length than the other to provide different height barriers depending on the side which is placed on the roadway, as is shown in FIGS. 4*a* and 4*b*. The basic operation of the resulting traffic barriers is similar to the one-piece lightweight barriers that are described below but would not be deployable from and to the roadway 106.

Figure 5A:
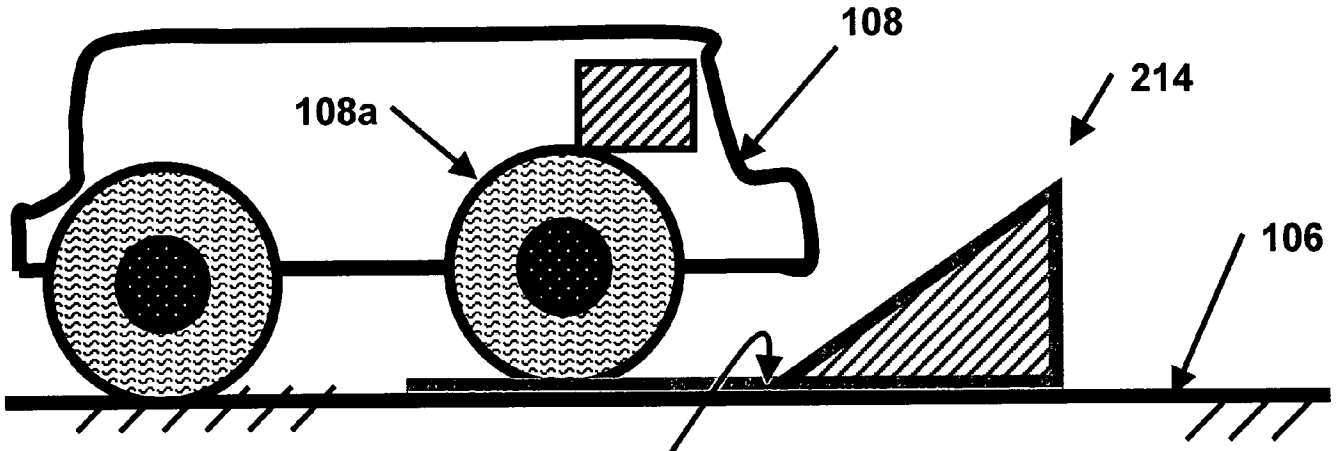
FIGS. 5*a* and 5*b* illustrate yet another embodiment of roadway blocks of the present invention.
Figure 5B:
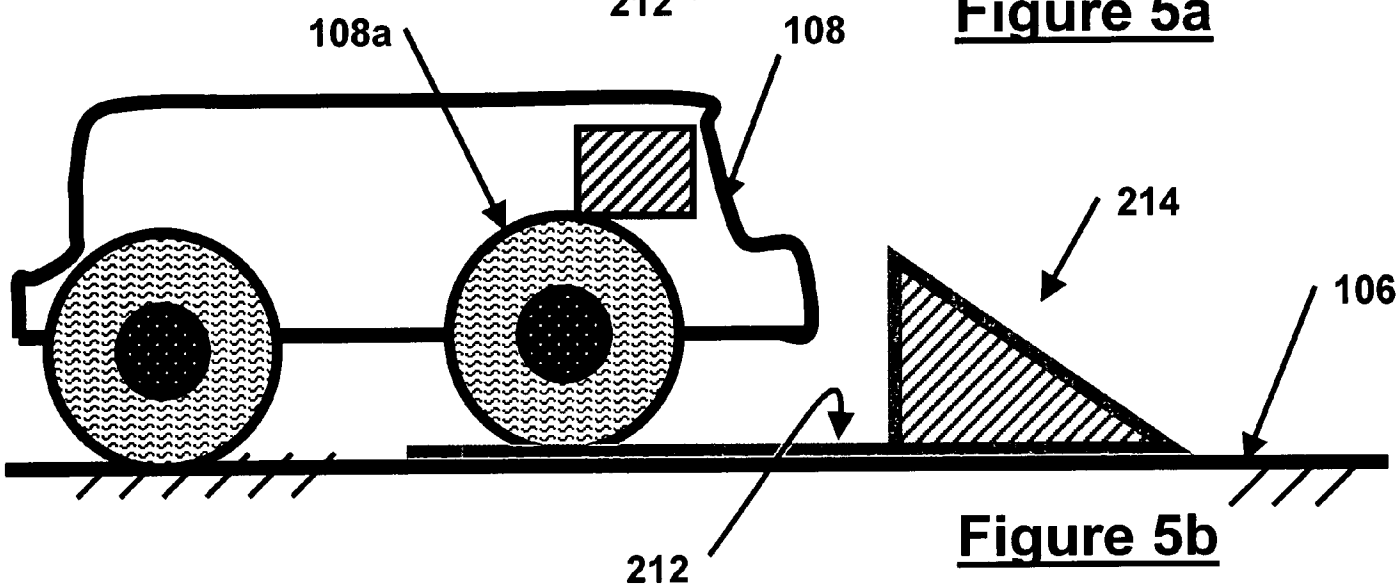

The schematics of typical one-piece design that can be used for traffic control barrier and/or car/truck stopper are shown in FIGS. 5*a* and 5*b*. The idea here is to use the weight of the vehicle 108 to increase the friction force between the block 214 and the ground. In these designs, the tire(s) 108*a* first move over a level portion 212 of the unit as shown in FIGS. 5*a* and 5*b*, before the bumper or the wheel itself hit the block 214. As a result, the weight on the tire provides the friction force against which the vehicle has to exert force in order to move the block 214. By providing high-friction materials under the unit, the friction force can be increased further. This design may be combined with that shown in FIG. 2*a* to allow the wheel to go over the bump and be suspended as the bump keeps the chassis of the vehicle up enough to prevent the wheel(s) to reach the ground. By providing enough number of such units along the path of vehicle travel, the vehicle can be readily brought to a stop. As shown in FIGS. 5*a* and 5*b*, the block 212 can be oriented to provide an arresting bump version and a security barrier version, respectively.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for at least slowing a vehicle moving along a surface in a direction, the method comprising;

providing two or more panels capable of extending above the surface, the two or more panels being disposed in series along the direction and spaced such that the two or more panels are capable of operatively engaging the vehicle in the direction to at least slow the vehicle, each of the two or more panels being independently deployable from the surface;

deploying at least one of the two or more panels from the surface into a position extended from the surface;

detecting at least one of a vehicle speed, vehicle type, and vehicle weight; and controlling the at least one of the two or more panels based on the detecting.

2. The method of claim 1, further comprising lifting at least a portion of the vehicle above the surface with the at least one of the two or more panels.

3. The method of claim 2, wherein the lifting comprises lifting the entire vehicle above the surface.

4. The method of claim 1, wherein the two or more panels are rotatably disposed on the surface, wherein each of the one two or more panels rotate in a same direction.

5. The method of claim 1, wherein the two or more panels comprises first and second panels rotatably disposed on the surface, wherein each of the first and second panels rotate in a different and opposite direction.

6. The method of claim 5, further comprising providing at least one center panel disposed between the first and second panels, the center panel being capable of being deployed into a position extended from the surface.

7. The method of claim 6, wherein the controlling controls the first, second, and center panels to act to regulate a speed of the vehicle.

8. The method of claim 6, wherein the controlling controls one or more of the first, second, and center panels to act as a security barrier against the barrier.

* * * * *